US010638250B2

(12) United States Patent
Hammerschmidt

(10) Patent No.: US 10,638,250 B2
(45) Date of Patent: Apr. 28, 2020

(54) SYSTEMS AND METHODS FOR DETERMINING ESTIMATED HEAD ORIENTATION AND POSITION WITH EAR PIECES

(71) Applicant: Apple Inc., Cupertino, CA (US)

(72) Inventor: Joachim S. Hammerschmidt, Mountain View, CA (US)

(73) Assignee: APPLE INC., Cupertino, CA (US)

( * ) Notice: Subject to any disclaimer, the term of this patent is extended or adjusted under 35 U.S.C. 154(b) by 199 days.

(21) Appl. No.: 15/714,952

(22) Filed: Sep. 25, 2017

(65) Prior Publication Data

US 2018/0091924 A1 Mar. 29, 2018

Related U.S. Application Data

(60) Provisional application No. 62/398,762, filed on Sep. 23, 2016.

(51) Int. Cl.
*H04R 5/02* (2006.01)
*H04S 7/00* (2006.01)

(52) U.S. Cl.
CPC ..... *H04S 7/304* (2013.01); *H04R 2420/07* (2013.01); *H04S 2420/01* (2013.01)

(58) Field of Classification Search
CPC . H04S 7/00; H04S 7/303; H04S 7/304; H04S 2420/01; H04R 2420/07
USPC ..... 381/17, 26, 309, 310, 74, 328, 380; 181/129, 130
See application file for complete search history.

(56) References Cited

U.S. PATENT DOCUMENTS 8,577,046 B2 * 11/2013 Aoyagi ..... H04R 3/005 367/124
8,718,930 B2 * 5/2014 Tachibana ..... G01C 21/00 701/428
2018/0220253 A1 * 8/2018 Karkkainen ..... H04S 7/303

* cited by examiner

*Primary Examiner* — Xu Mei
(74) *Attorney, Agent, or Firm* — BakerHostetler

(57) ABSTRACT

Aspects of the present disclosure provide systems and methods for determining an estimated orientation and/or position of a user's head using worn ear pieces and leveraging the estimated head orientation and/or position to provide information to the user. In one exemplary method, first and second spatial positions of respective first and second ear pieces worn by a user may each be determined. Based at least in part on the first and second spatial positions of the respective first and second ear pieces, an estimated orientation of the user's head may be determined. The method may further include requesting information to be provided to the user based at least in part on the estimated orientation of the user's head and providing contextual information to the user responsive to the request.

48 Claims, 9 Drawing Sheets

100

300

400

500

600

700

800

900

SYSTEMS AND METHODS FOR DETERMINING ESTIMATED HEAD ORIENTATION AND POSITION WITH EAR PIECES

CROSS REFERENCE TO RELATED APPLICATIONS

This application claims benefit under 35 U.S.C. § 119(e) of Provisional U.S. patent application No. 62/398,762, filed Sep. 23, 2016, the contents of which are incorporated herein by reference in their entirety.

BACKGROUND

The present disclosure relates to determining an estimated head orientation and position using ear pieces.

Mobile devices, such as smart phones or tablet computers, are commonly used as an informational and/or navigational aid to a user. In a conventional configuration, the positioning of the mobile device itself may be tracked, such as by GPS (global positioning system). The positioning of the mobile device may be used, for example, in a navigation program on the mobile device to show the user his or her geographical location and even information about nearby restaurants, stores, etc.

SUMMARY

Systems and methods for determining estimated head orientation and position with ear pieces are disclosed. An exemplary method may comprise determining a first spatial position of a first ear piece worn by a user and a second spatial position of a second ear piece also worn by the user. Based at least in part on the first and second spatial positions, the method may estimate an orientation of the user's head.

In an aspect, audio output of the ear pieces may be altered based on the estimated orientation of the user's head. In an aspect, the contextual information provided to the user may be responsive to an input requesting information. In another aspect, a spatial position of the user's head may be estimated based on the first and second positions of the first and second ear pieces, respectively. The contextual information provided to the user may be further based on the spatial position of the user's head. The contextual information may be provided to the user via the first and second ear pieces or via a display associated with the first and second ear pieces. In another aspect, the estimated orientation of the user's head may be determined further based on an orientation angle representing an orientation about an axis extending between the first ear piece and the second ear piece.

An exemplary method may comprise receiving a search input indicative of an object positioned in an environment. The method may determine a first spatial position of a first ear piece worn by the user and a second spatial position of a second ear piece also worn by the user. Based at least in part on the first and second spatial positions, the method may determine an estimated orientation of the user's head. A facing direction of the estimated orientation of the user's head may be compared with the position of the object. Based at least in part on this comparison, an instruction may be generated to assist the user in locating the object. In an aspect, the instruction may be generated further based on a spatial position of the user's head. In another aspect, the method may determine if that the object corresponds with the facing direction of the orientation of the user's head. If the object corresponds with the facing direction of the estimated orientation of the user's head, the instruction may indicate so. If not, the instruction may include a movement direction of the user.

An exemplary device may comprise a processor and a memory storing instructions that, when executed by the processor, effectuate operations. The operations may comprise determining a first spatial position of a first ear piece worn by the user and a second spatial position of a second ear piece also worn by the user. Based at least in part on the first and second spatial positions, the operations may determine an estimated orientation of the user's head. The operations may determine that the object corresponds with a facing direction of the estimated orientation of the user's head and generate information relating to the object that is to be provided to the user.

An exemplary set of ear pieces to be worn by a user comprises a first ear piece and a second ear piece. The first and second ear pieces may each comprise a first and second positional transceiver, respectively. The set of ear pieces may further comprise a processor disposed within at least one of the first and second ear pieces and configured to effectuate operations. The operations may comprise determining a first spatial position of the first ear piece based at least in part on wireless signals received by the first positional transceiver and determining a second spatial position of the second ear piece based at least in part on wireless signals received by the second positional transceiver. Based at least in part on the first and second spatial positions, the operations may estimate an orientation of the user's head. In an aspect, the set of ear pieces further may comprise a speaker via which information may be provided to the user. The information may be based at least in part on the estimated orientation of the user's head. The set of ear pieces further may comprise a microphone and the operations may capture a parameter of a search request via the microphone. The set of ear pieces further may comprise a motion sensor and the orientation of the user's head may be estimated further based on sensor data captured by the motion sensor.

An exemplary method may comprise determining a first spatial position of a first ear piece worn by a user and a second spatial position of a second ear piece also worn by the user. Based at least in part on the first and second spatial positions, the method may determine an estimated orientation of the user's head. The method may generate first audio content that is modified, based at least in part on the estimated orientation of the user's head, from second audio content. The first audio content may be provided to a user via the first and second ear pieces. In an aspect, the generating the first audio content may comprise setting an audio attribute of the first audio content, such as volume, frequency equalization, high frequency cut-off, low frequency cut-off, and relative timing between channels of the audio content. In another aspect, the first audio content may comprise first and second audio channels and the generating the first audio content may comprise setting an audio attribute of the first audio channel to a first value and setting an audio attribute of the second audio channel to a second value that is different from the first value.

DETAILED DESCRIPTION

Many mobile devices attempt to provide information to a user of the device by tailoring information to a user's frame of reference (e.g., "turn left"). Typically, such mobile devices contain positioning systems such as GPS and perhaps gravity sensors that determine the devices' orientation in free space. Such devices, however, often provide coarse or inaccurate information because the devices' orientation with respect to the operator cannot be determined accurately. Mobile devices may be placed in pockets, mounted in cars or otherwise provided in a location whose orientation relative to the user cannot be determined. As still another complication, the mobile devices' orientation may change with respect to the user.

Aspects of the present disclosure provide systems and methods for determining an estimated orientation and position of a user's head using worn ear pieces and leveraging the estimated head orientation and position to provide information to the user, such as to help the user locate an object within the user's environment or to provide information relating to an object identified within the estimated head orientation. In one exemplary method, a first spatial position of a first ear piece worn by a user and a second spatial position of a second ear piece worn by the user may each be determined. Based at least in part on the first spatial position of the first ear piece and the second spatial position of the second ear piece, an estimated head orientation of the user may be determined. The method may further include requesting information to be provided to the user based at least in part on the estimated head orientation and providing information to the user responsive to the request. The method may further determine a position of the user's head based on the first and second spatial positions of the ear pieces, which also may serve as a basis for the provided information.

Figure 1:
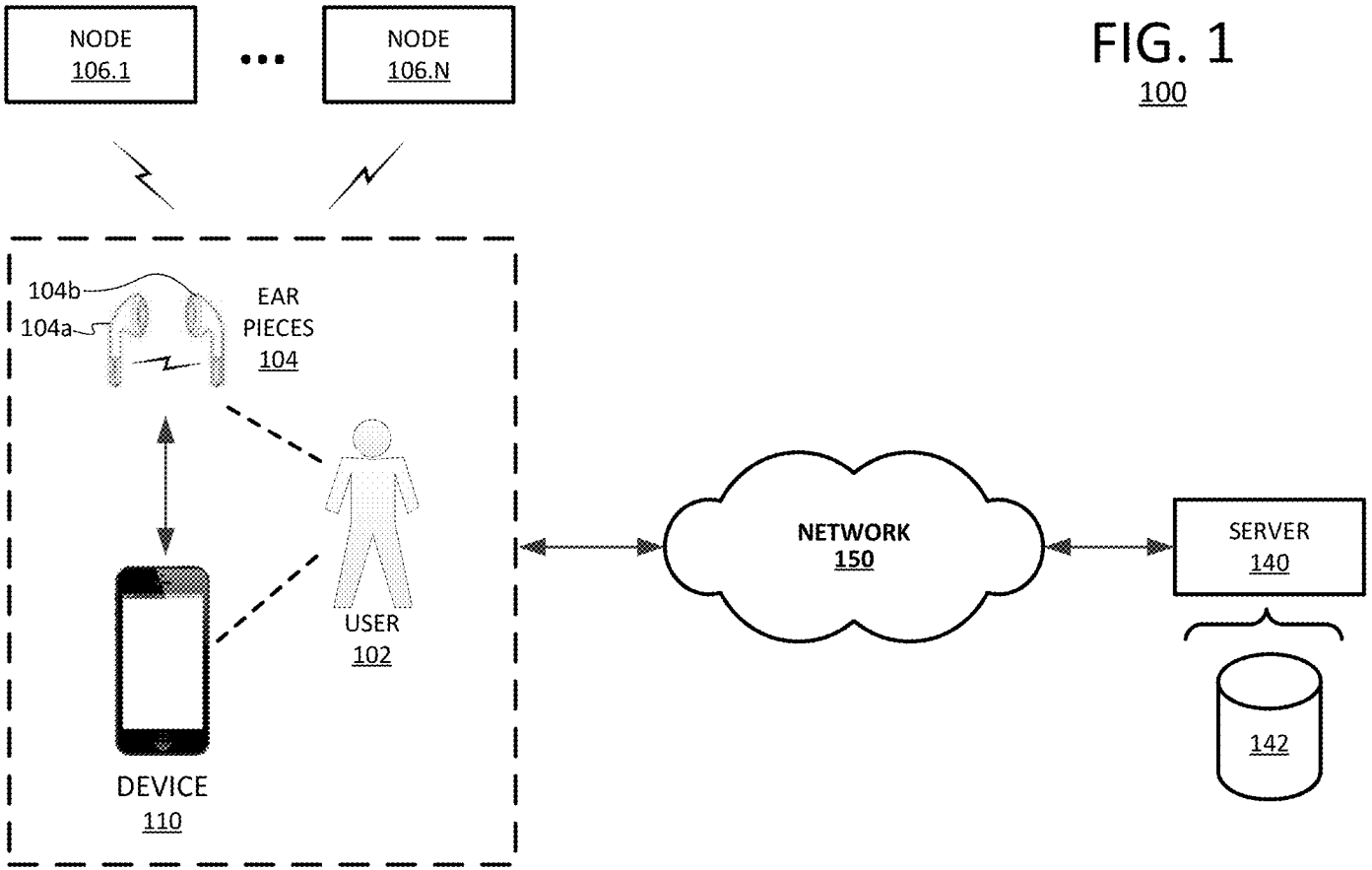
FIG. 1 illustrates an exemplary system according to an aspect of the present disclosure.

FIG. 1 illustrates a system 100 according to an aspect of the present disclosure. The system 100 may include a pair of ear pieces (collectively 104) and a plurality of positional nodes 106.1-106.N. The ear pieces 104 may be worn by a user 102 in a selected manner, such as by wearing a left ear piece 104*a* in a left ear of the user 102 and a right ear piece 104*b* in a right ear of the user 102. The ear pieces 104 may determine their relative position with reference to signals generated by the positional nodes 106.1-106.N. From the relative position determination, the ear pieces 104 may estimate an orientation and position of the user's head, including the head's facing.

The positional nodes 106.1-106.N may be Wi-Fi access points that transmit Service Set Identifier (SSID) and Media Access Control (MAC) data, cellular network transmitters (e.g., base stations or small cells), any other suitable wireless access points, and/or a combination thereof. The positional nodes 106.1-106.N may be provided in a variety of ways. In one aspect, the positional nodes 106.1-106.N may be deployed about a physical space at known locations, and transmit (and/or receive) ranging signals.

The ear pieces 104 may include receiver circuitry to receive signals from these nodes 106.1-106.N and estimate location therefrom. In one aspect, the ear pieces 104 may estimate location wholly independently of other components, in which case, the ear pieces 104 may include both receiver circuitry to receive transmitted signals from the nodes 106.1-106.N and processing circuitry to estimate location based on the received signals. In another aspect, the ear pieces 104 may work cooperatively with other processing systems, such as a user device 110 and/or a server 140, to estimate location. In this latter aspect, the ear pieces 104 may receive transmitted signals from the nodes 106.1-106.N and develop intermediate signals representing, for example, strength and/or timing information derived from the received signals; other components (the device 110 and/or the server 140) ultimately may estimate location from the intermediate signals.

Aspects of the present disclosure also provide techniques for consuming data representing the estimated head orientation that is obtained from use of the ear pieces 104. For example, the estimated head orientation and/or position may be used in informational and/or navigational searches as discussed above, in which search results may be presented to a user 102 using references that are tied to the user's head orientation. For example, estimations of orientation may be applied in the following use cases:

In one aspect, a virtual guide service may employ estimates of a user's head orientation and/or position to provide contextual information that is tailored to a user's frame of reference. For example, a user's field of view may be estimated from the user's head orientation and/or position and compared to information of interest. When objects of interest are determined to be located within or near the user's field of view, contextual information may be provided to the user. For example, when navigating a shopping area to reach a desired item, an estimation of head orientation and/or position may determine which direction the user 102 is facing at the onset of a search. Those search results may factor the head orientation and/or position into the presented information (e.g., "the eggs are behind you and to the right. Turn around and turn right at the end of the row."). In another example, a user that browses through a museum tour may be presented information on objects that are estimated to be within the user's field of view based on estimates of the user's head orientation and/or position. In one aspect, user input and search results may be via spoken exchange, in which case, the ear pieces 104 may capture user commands via a microphone and provide search results through speakers (not shown). In another aspect, user input and/or search results may be provided via the associated device 110.

In another aspect, a spatial audio service may employ estimates of a user's head orientation and/or position to emulate a three dimensional audio space. For example, audio information may be provided to the users through speakers in the ear pieces 104. If/when the user changes orientation of the head, the audio playback may be altered to provide effects that emulate a three dimensional space. For example, in a space with live performances of music, audio may be provided from a specific location in free space (e.g., a stage). To emulate the effect as a user changes orientation of the head, audio playback through speakers of the ear pieces 104 may be altered to emulate changes that arise due to the changed orientation. If one ear is oriented toward the direction from which audio is to be sourced, volume of audio in the associated speaker may be increased. Similarly, if another ear is orientated away from the direction from which audio is to be source, volume of the audio in the associated speaker may be decreased. Similarly, an immersive audio experience may locate different sources of audio in different locations in a modeled three-dimensional space; as the user changes orientation within this space, the contributions of each source may be altered accordingly.

In a further aspect, a virtual reality service may employ estimates of a user's head orientation and/or position to govern presentation of visual information through a peripheral device (for example, a display). Here, a user's field of view in a modeled three-dimensional space may be estimated from estimates of a user's head orientation in free space. Visual elements may be presented on an associated display (e.g., goggles or other display device) by mapping the estimated field of view to content in the modeled three-dimensional space.

The ear pieces 104 and/or the device 110 may be communicatively connected, via a network 150, to a server 140 to effectuate various operations described herein relating to the estimated head orientation of the user 102. The network 150 may represent any number of networks capable of conveying the various data communications described herein, including for example wireline and/or wireless communication networks. Representative networks include telecommunications networks (e.g., cellular networks), local area networks, wide area networks, and/or the Internet.

The server 140 may represent one or more computing devices that may interact with the device 110 and/or the ear pieces 104. The server 140, for example, may provide a service to the user that incorporates estimated head orientation and/or position as an input that can alter provision of the service. The server 140 may include an environmental data repository 142 that may store and provide information relating to an environment in which the user 102 may be present (e.g., audio information or visual information in the examples illustrated above). For example, the environmental data repository 142 may include information describing one or more objects found in the environment. As used herein, an "object" may refer to any suitable physical or logical element found in a physical environment or a virtual (e.g., computer generated) environment. For example, an object may be a physical object, such as a product found in a store, an artifact in a museum, or a building or other physical landmark in an outside environment. As another example, an object may further refer to a logically-defined object, such as area within an environment (e.g., the entrance or exit area of a building, the area surrounding an animal exhibit at a zoo, an area encompassing a section of store shelving, or an area collectively representing one or more sub-objects). As yet another example, an object may also refer to an area or element in a computer user interface, wherein the computer user interface is considered the environment.

The environmental data repository 142 may include further information relating to each object, such as in a cross-referenced table. The information relating to an object may include a name or other identifier of the object, a location of the object within the environment (e.g., an x, y, z coordinate set), and a description of the object. The specific information relating to an object may depend on the particular type of object. For example, information relating to a store product may include a price of the product, a category of the product, a product description, and a location of the product in the store. Information relating to a food product may further include a list of ingredients or allergen information. Information relating to an artifact in a museum may include the location of the artifact in the museum and educational information on the artifact, such as the time period of the artifact and the historical relevance of the artifact. Information relating to a building or physical landmark may include, for example, an address, a visual description (e.g., an indication that a building is made from red brick), and architectural or historical information relating to the building or physical landmark.

The information relating to an object provided by the environmental data repository 142 may be leveraged in various operations described in greater detail herein. For example, the position of an object may be compared with the facing of a user's head to determine if the object corresponds to that facing and, if not, provide instructions to the user 102 to adjust his or her body position and/or head orientation so that the object corresponds with the head's facing. As another example, a table of objects from the environmental data repository 142 may be cross-referenced with a facing direction of a user's head to determine one or more objects that correspond with that facing direction. Upon determining that an object is corresponds with the facing direction, additional information may be provided to the user 102, such as the price and ingredients for a food product or historical information for a museum artifact.

In an aspect, the environmental data repository 142, or portion thereof, may be stored locally on the device 110, in addition to or instead of being stored on the server 140.

Figure 2:
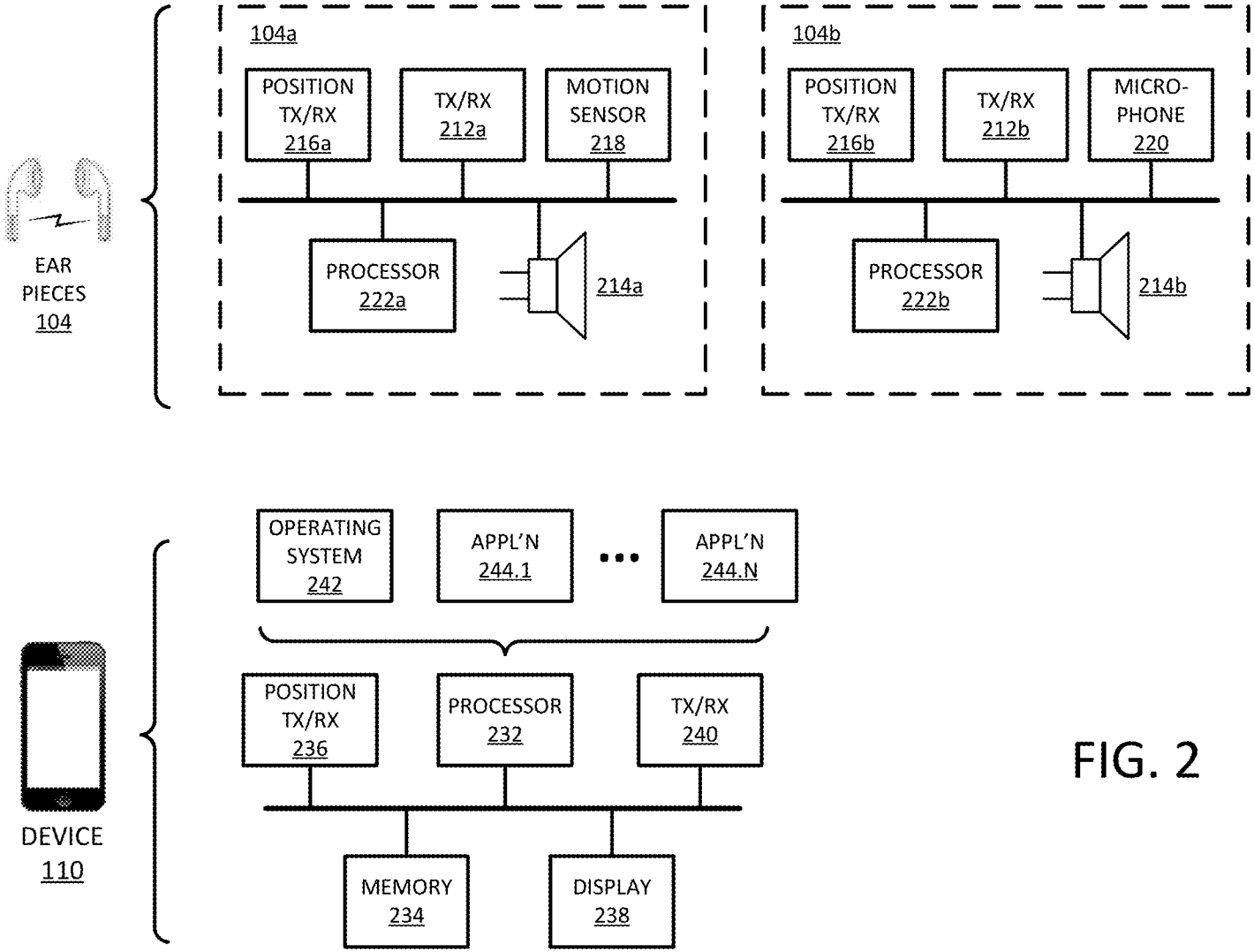
FIG. 2 illustrates an exemplary set of ear pieces and a device, each according to an aspect of the present disclosure.

FIG. 2 is a simplified block diagram of the ear pieces 104 and the device 110 according to an aspect of the present disclosure. As discussed above, the ear pieces 104 may include a left ear piece 104*a* and a right ear piece 104*b*. The left ear piece 104*a* is intended to be worn on or in the user's 102 left ear and the right ear piece 104*b* is intended to be worn on or in the user's 102 right ear. The ear pieces 104 may possess ergonomic configurations that are suitable for human users, which may resemble the in-ear ear pieces or over-the-ear headphones commonly used with mobile devices, such as a smart phone or portable music player, to listen to music and/or effectuate voice communication.

The ear pieces 104 may include a pair of transceivers 212*a*, 212*b*, a pair of positional transceivers 216*a*, 216*b*, a motion sensor 218, and one or more processors 222*a*, 222*b*. The transceivers 212*a*, 212*b* may provide communication connectivity between the two ear pieces 104 and, optionally, with other components such as the device 110 and/or the server 140. The positional transceivers 216*a*, 216*b* may receive signals from the nodes (FIG. 1) at each of the ear pieces 104 and estimate characteristics of the received signals. The motion sensor 218 may estimate orientation of an ear piece 104 with respect to gravity. The processors 222*a*, 222*b* may manage overall operation of the ear pieces 104.

The ear pieces 104 also may include components that are common to headsets. For example, FIG. 2 illustrates the ear pieces 104*a*, 104*b* as having respective speakers 214*a*, 214*b* and at least one microphone 200 between them.

As mentioned, one or more of the ear pieces 104 may each include a processor 222*a*, 222*b*. The processors 222*a*, 222*b* may facilitate various operations disclosed herein, including managing operations of the ear pieces 104 and facilitating communication with other components. For example, one or more of the processors 222*a*, 222*b* may perform computations to calculate the estimated head orientation of the user. One or more of the processors 222*a*, 222*b* may interface with other components, such as the device 110 and/or the server 140, to perform a search based on an estimated orientation of the user's head. As another example, one or more of the processors 222*a*, 222*b* may compose spoken language prompts, instructions, or other audio outputs to the user 102. As yet another example, one or more of the processors 222*a*, 222*b* may perform speech conversions of speech input provided by the user 102. As another example, the one or more processors may generate one or more computer-generated elements to be presented on the display 238 or other display device associated with the device 110. The computer-generated elements may be superimposed over a real-time display or view of the user's 102 environment. Such presentation is sometimes referred to as augmented reality.

As indicated, the transceivers 212*a*, 212*b* may provide communication connectivity between the ear pieces 104 and, optionally, with other components such as the device 110 and/or the server 140. The transceivers 212*a*, 212*b* may each be embodied as a wireless communication interface (e.g., Bluetooth, Wi-Fi, or cellular) and/or a wired communication interface (e.g., a Lightning® interface from Apple, Inc. of Cupertino, Calif.). The transceivers 212*a*, 212*b* may transmit and/or receive digital audio and/or voice data. For example, the ear pieces 104 may receive audio instructions from the device 110 via the transceivers 212*a*, 212*b* that direct the user 102 to move in a particular direction or direct the user 102 to turn the user's 102 head in a particular manner. The transceivers 212*a*, 212*b* additionally may transmit and/or receive data relating to the position and orientation of the left and right ear pieces 104*a*, 104*b*, as well as the orientation of the user's 102 head. For example, having determined that the left and right ear pieces 104*a*, 104*b* are located at a particular position in space and oriented at a certain angle, such data may be transmitted via the transceivers 212*a*, 212*b* to the device 110 so that the device 110 may generate instructions for the user 102 to modify the orientation of his or her head.

The positional transceivers 216*a*, 216*b* may receive signals from the nodes 106.1-106.N (FIG. 1) at each of the ear pieces 104 and estimate characteristics of the received signals, which may be used to determine the position of each of the left and right ear pieces 104*a*, 104*b*. In an aspect in which the positional nodes 106.1-106.N are configured to provide and/or receive wireless ranging signals, the positional transceivers 216*a*, 216*b* may be similarly configured to transmit and/or receive those wireless ranging signals. In an aspect in which the positional nodes 106.1-106.N are Wi-Fi access points, the positional transceivers 216*a*, 216*b* may be configured with Wi-Fi interfaces to communicate with the Wi-Fi access points. In an aspect in which the positional nodes 106.1-106.N are GPS transmitters, the positional transceivers 216*a*, 216*b* may be configured as GPS receivers. In an aspect in which the positional nodes 106.1-106.N are cellular network transmitters, the positional transceivers 216*a*, 216*b* may include a cellular interface for communicating with the cellular network transmitters. The positional transceivers 216*a*, 216*b* may be disposed at a location within the respective ear pieces 104*a*, 104*b* to maximize the distance between the ear pieces 104*a*, 104*b* and, thus, allow an optimally accurate determination of the relative spatial positions of the ear pieces 104*a*, 104*b*.

In one aspect, the positional transceivers 216*a*, 216*b* and the transceivers 212*a*, 212*b* may be respectively embodied as the same component. That is, the left ear piece 104*a* may include a transceiver 212*a* configured to fulfill the aforementioned functionality of the positional transceiver 216*a* and the transceiver 212 and the right ear piece 104*b* may include another transceiver 212*b* configured to fulfill the functionality of the positional transceiver 216*b* and the transceiver 212*b*.

The motion sensor 218 may estimate orientation of an ear piece 104*a*, 104*b* with respect to gravity. The motion sensor 218 may be an accelerometer or a gyroscope, as some examples. The motion sensor 218 may measure the orientation of the user's 102 head about an axis extending through the left and right ear pieces 104*a, b* (i.e., the orientation of the user's 102 head such as if the user 102 was nodding). The motion sensor 218 may also measure the side-to-side orientation or tilt of the user's 102 head.

The left and right ear pieces 104*a*, 104*b* additionally may each include a respective speaker 214*a*, 214*b* for providing audio to the user 102. For example, audio instructions to the user 102 based on the estimation of the user's 102 head orientation may be delivered via the speakers 214*a*, 214*b*. At least one of the left and right ear pieces 104*a*, 104*b* may be configured with a microphone 220. The microphone 220 may allow, for example, the user 102 to provide speech input to the device 110 and/or the ear pieces 104 themselves.

As indicated, in some aspects, the ear pieces 104 may work cooperatively with other devices, such as the device 110. The device 110 may be embodied as a mobile device (e.g., a smart phone, a cellular phone, a portable music play, a portable gaming device, or a tablet computer), a wearable computing device (e.g., a smart watch or an optical head-mounted display), or other type of computing device. The device 110 may be configured with a memory 234 and a processor 232. The memory 234 may store an operating system 242 and one or more applications 244.1-244.N that may perform various operations relating to an estimated orientation of the user's head. The operating system 242 and the applications 244.1-244.N may be executed by the processor 232. For example, the processor 232 and/or applications 244.1-244.N may perform one or more of the functions described in relation to the processors 222*a*, 222*b*, such as determining the spatial positioning and orientation aspects of the ear pieces 104 and/or providing information, instructions, or other output to the user 102.

The device 110 may further include a display 238 to visually display the operating system 242 and the applications 244.1-244.N and facilitate interaction of the user 102 with the device 110. The device 110 may further be configured with an input (not shown), such as a pointing device, touchscreen, one or more buttons, a keyboard, or the like by which the user may interact with the operating system 242 and the applications 244.1-244.N.

The device 110 may additionally be configured with a transceiver 240 and/or a positional transceivers 236. The transceiver 240 may include a wireless or a wired communication interface and may be used to effectuate communication between the device 110 and the ear pieces 104 and/or between the device 110 and the server 140. For example, the transceiver 240 may include a Bluetooth interface to communicate with correspondingly-equipped wireless ear pieces 104. As another example, the transceiver 240 may include a cellular communication interface to enable communication over a cellular network with, for instance, the server 140. It will be appreciated that the device 110 may include more than one transceiver 240, such as one for communicating with the ear pieces 104 and another for communicating with the server 140. The positional transceiver 236 of the device 110 may be used to determine the location of the device 110 and, therefore, also the location of the user 102. For example, the positional transceiver 236 may include a GPS receiver.

Figure 3:
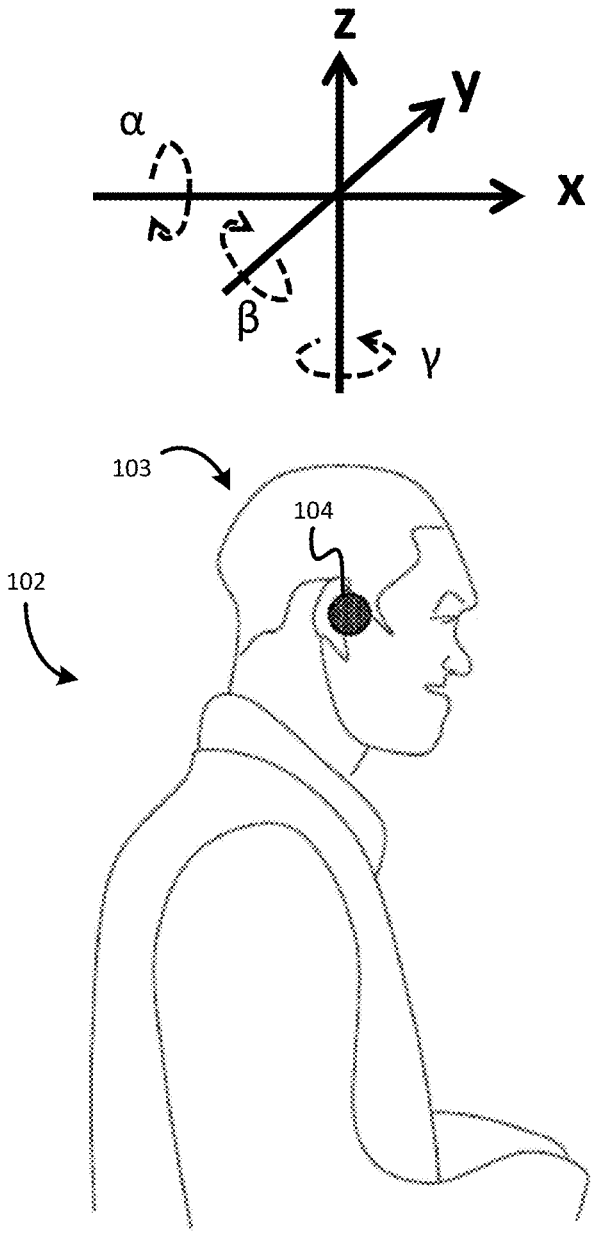
FIG. 3 illustrates a user and axes of position and orientation.

FIG. 3 illustrates an exemplary use of ear pieces 104 according to an aspect of the present disclosure. As illustrated, the ear pieces 104 are worn by a user 102 on the user's head 103. The spatial position of the head 103 may be represented as X, Y, and Z coordinates on the respective axes. The estimate of the user's 102 head orientation may be determined by establishing the discrete rotation angles of the head 103 (shown by α, β, and γ angles). In this example, the angle α may refer to the angle of rotation about the X axis, i.e., the lateral (left/right) or sideways tilt of the head 103. The angle α may also be referred to as "roll." Similarly, angle β may refer to the angle of rotation about the Y axis, i.e., the forward-backward rotational position of the head 103, such as during a nod. The angle β may also be referred to as "pitch." Finally, the angle γ may refer to the angle of rotation about the Z axis, i.e., the rotational position of the head 103 about the axis of the neck, such as while swiveling the head 103 from left to right. The angle γ may also be referred to as "yaw." Different implementations, of course, may develop different spatial and/or angular representations to derive estimation of head orientation and spatial positioning.

In addition, the rotation angles α, β, and γ may define a planar orientation of a user's 102 head. The direction orthogonal to the planar orientation of the user's face may be considered the direction to which the head is facing. In some instances, it may be inferred that the head's directional facing may generally correspond with the user's 102 viewing direction or field of view.

Figure 4:
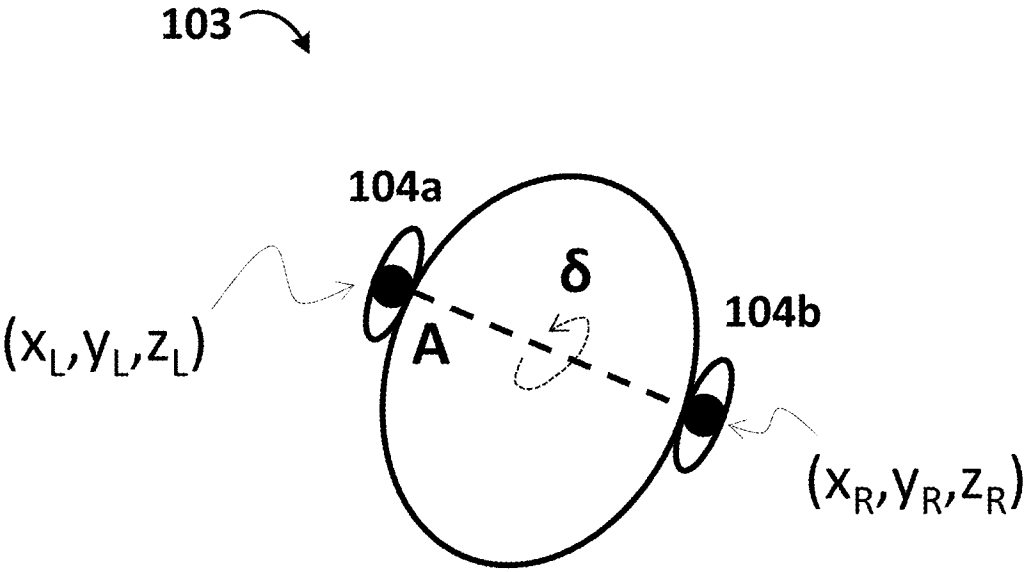
FIG. 4 illustrates a head of a user wearing an exemplary set of ear pieces.

FIG. 4 also illustrates an exemplary use of the ear pieces 104 according to an aspect of the present disclosure. Here, FIG. 4 illustrates a top down view, which shows the left ear piece 104*a* positioned in the user's 102 left ear and the right ear piece 104*b* positioned in the user's 102 right ear. The left ear piece 104*a* and the right ear piece 104*b* may define an axis A between them. The left ear piece 104*a* and the right ear piece 104*b* also have spatial positions ($X_L$, $Y_L$, $Z_L$) and ($X_R$, $Y_R$, $Z_R$), respectively, within the coordinate space (FIG. 3) in which the user 102 is located. Thus, the system 100 may estimate independent spatial positions of the left ear piece 104*a* and the right ear piece 104*b* within the coordinate space and further estimate a spatial position of the head 103 therefrom. For example, a halfway point between the left ear piece 104*a* and the right ear piece 104*b* along the axis A may be considered as the spatial location of the head 103. Further, the relationship of the spatial position ($X_L$, $Y_L$, $Z_L$) of the left ear piece 104*a* with the spatial position ($X_R$, $Y_R$, $Z_R$) of the right ear piece 104*b* may be used to derive the rotation angle α (i.e., the sideways "tilt" or roll of the head 103) and the rotation angle γ (i.e., the "swivel" or yaw of the head 103).

The rotation angle δ (i.e., pitch of the head 103) may be measured using the motion sensor 218 disposed in one or more of the ear pieces 104. For example, the motion sensor 218 may measure the direction of the earth's gravity field as the head is rotated about the axis A. The motion sensor 218 may detect, for example, the rotation angle δ according to the direction of the earth's gravity field with respect to those rotational positions and/or changes thereof. Thus, between the positional location estimates ($X_L$, $Y_L$, $Z_L$) and ($X_R$, $Y_R$, $Z_R$) of the ear pieces 104 and orientation data from the motion sensor 218, a six degree of freedom estimate (X, Y, Z, α, β, γ) of the user's head may be developed.

Figure 5:
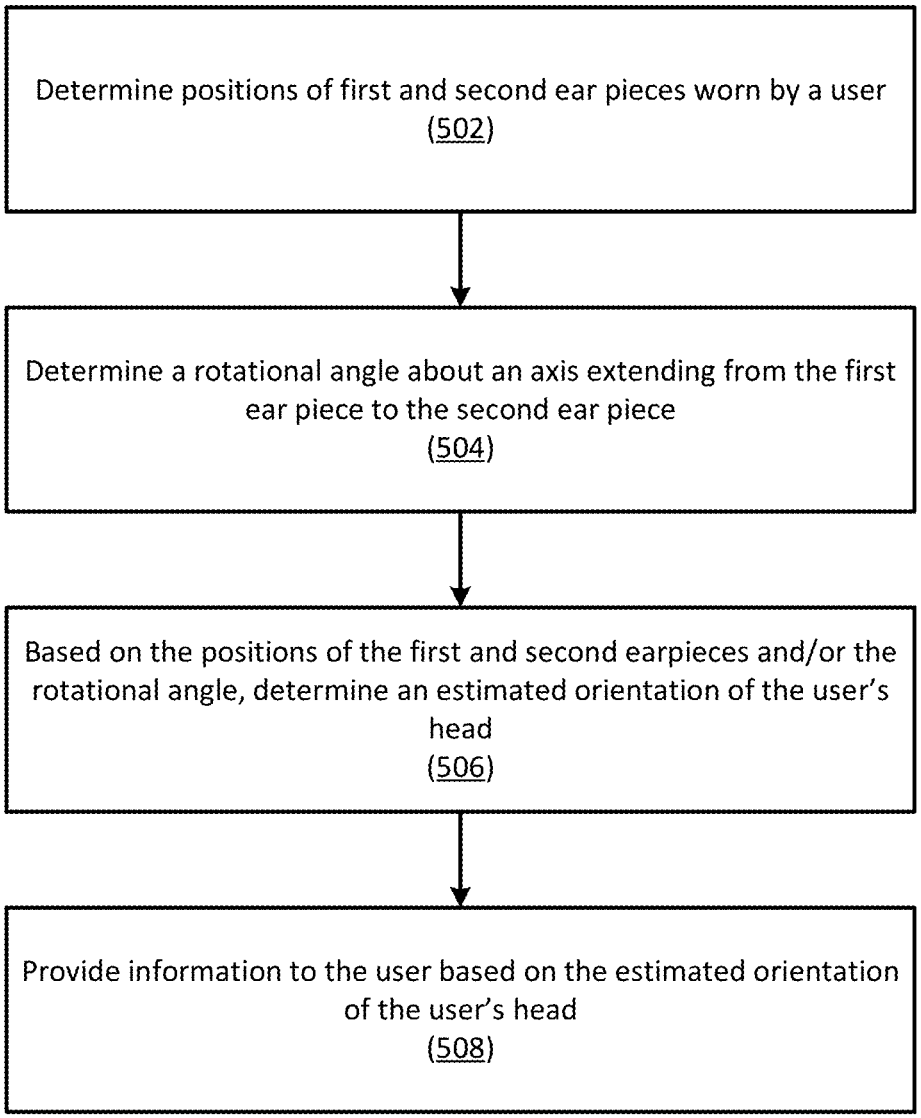
FIG. 5 illustrates a method according to an aspect of the present disclosure.

FIG. 5 illustrates one exemplary method 500 according to an aspect of the disclosure. The method 500 may determine positions of first and second ear pieces (e.g., the left and right ear pieces 104*a*, 104*b*) worn by the user (box 502). For example, the spatial position ($X_L$, $Y_L$, $Z_L$) of the left ear piece and the spatial position ($X_R$, $Y_R$, $Z_R$) of the right ear piece may be determined. The method 500 also may determine a rotation angle (e.g., the rotation angle δ) about an axis (e.g., the axis A) extending from the first ear piece to the second ear piece (box 504). For example, the rotation angle δ about the axis A may be measured by the motion sensor 218 included in at least one of the left and right ear pieces.

The method 500 may determine an estimated head orientation and/or position of the user based, at least in part, on the positions of the first and second ear pieces from step 502 and/or the rotation angle from step 504 (box 506). As described above in relation to FIGS. 3 and 4, previously determined spatial positions ($X_L$, $Y_L$, $Z_L$), ($X_R$, $Y_R$, $Z_R$) of the left and right ear pieces may provide information from which the spatial position of the head may be determined, as well as the orientation angle α (i.e., the sideways "tilt" of the head) and the rotation angle γ (i.e., the "swivel" of the head). The rotation angle δ about the axis A provides information from which the rotation angle β (i.e., the forward-backward "nodding" orientation of the head) may be determined. Once the three-dimensional spatial position of the head and each of the three orientation characteristics of the head are known, the orientation of the user's head and the spatial position of the user's head may be accordingly determined. It is noted, however, that in some aspects a sufficient estimated orientation direction may be determined without using the rotation angle β. For example, in an environment in which there is little or no significance as to whether the head's facing is pointing upward or pointing downward, the estimated head rotation may be determined without factoring in the rotation angle β.

The method 500 may provide information to the user based on the estimated head orientation of the user (box 508). The information may be further based on the spatial position of the user's head. The information provided to the user may relate to the environment in which the user is present and/or an object within the environment. As an example, the area of the environment corresponding to the directional facing of the user's head may be cross-referenced with known information describing the environment and objects within (e.g., from the environmental data repository 142 of the server 140 shown in FIG. 1). The information describing the environment may include, for example, a table of the objects, with each object being associated with a location within the environment and information describing or otherwise relating to the object. Using the estimated head orientation and/or position, it may be determined that the user's head faces that object and information describing or otherwise relating to that object may be provided to the user As another example of the information provided to the user, the user may have previously input a query for a desired object (e.g., a particular store item or a location in the environment, such as a restroom). It may be determined whether the user's head faces the desired object. If the user's head does face the desired object, this may be so indicated to the user. If not, the user may be provided one or more instructions, based on the orientation and/or position of the user's head, on how to reach the desired object. For instance, if the desired object is located approximately ninety degrees to the right of a central axis of head's facing, the information provided to the user may direct the user to turn ninety degrees to the right and proceed ahead in that direction until reaching the desired object. In this example, it is presumed that the user's body is generally facing the same direction as the user's head. A reminder may be provided to the user, such as preceding or during steps 502 and/or 504, for the user to look straight ahead relative to his or her body. In another example, the instructions provided to the user may be with respect to the user's head rather than to the user's body. These instructions may direct the user to turn his or her head the ninety degrees to the right and move in the direction corresponding to the adjusted head facing.

The information provided to the user may also include instructions for the user to move his or her head based on the estimated head orientation. It may be determined that the user is in the generally correct position within the environment for the desired object, but the desired object does not correspond with the head's facing. For example, the user may be orienting his or her head to point towards the bottom portion of a shelf in a store while the desired product is on the top shelf. Accordingly, the user may be provided instructions to rotate his or her head upwards to an angle at which the desired object may be seen. In the aforementioned store shelf example, the user may be directed to rotate his or her head upwards by, for example, forty-five degrees.

In an aspect, the information provided to the user may comprise one or more computer-generated elements. The computer-generated element may be provided in an augmented reality implementation in which the computer-generated element may be superimposed over or displayed with a real-time or near real-time view of the user's environment. The view of the user's environment may be presented via the display or another device that is associated with the device and/or ear pieces. Such other device may comprise an optical head-mountable display. In an example, the computer-generated element may comprise a directional arrow. The directional arrow may point in the direction to which the user is intended to rotate his or her head. For example, if an object sought by a user is above the user (e.g., a retail product on a top shelf), the directional arrow may point upwards to signal the user to rotate his or her head upwards. In other aspects, the computer-generated elements may be presented in conjunction with other computer-generated elements. For example, the computer-generated element representing the information for the user may be displayed in a virtual reality environment. The virtual reality environment may represent the user's real-world environment, for example.

One or more of the steps 502, 504, and 506 each may be performed by the ear pieces, the device, and/or the server (or other device in the network). For example, the data resulting from the ear piece interactions with the nodes and/or the data from the motion sensor may be initially gathered by the ear pieces and/or the device. This data may be transmitted to the server. The server may process the data to determine the positions of the first and second ear pieces, determine the rotation angle about the axis extending between the ear pieces, and determine the estimated head orientation and/or position of the user. The server may further generate the resultant information for the user and transmit that back to the device and/or ear pieces.

In an aspect, one or more of the steps 502-508 may be repeated after the initial information is provided to the user. For example, steps 502-506 may be continuously (or at set time intervals) repeated to evaluate the user's estimated head orientation and/or spatial position of the head as the user attempts to follow the instructions provided in step 508. Continuing the aforementioned store shelf example, the estimated head orientation may be continuously determined as the user rotates his or her head upwards, preferably to the desired product on the top shelf. If it is determined that the product does not correspond with the facing of the user's head, new instructions may be provided to the user such as to indicate that the user should continue to rotate his or her head upward or, if the user has looked too far upwards, to indicate that the user should rotate his or her head downward. As the estimated head orientation is continuously determined and evaluated, it may be finally determined that the product corresponds with the facing direction of the user's head. At this point, instructions may be provided to the user to stop moving his or her head and that the product should correspond with his or her head facing.

The information may be provided to the user via one or more of several mechanisms. For instance, the information may be aurally provided to the user via the speakers of the ear pieces. Additionally or alternatively, the information may be visually provided to the user on the display of the device.

Figure 6:
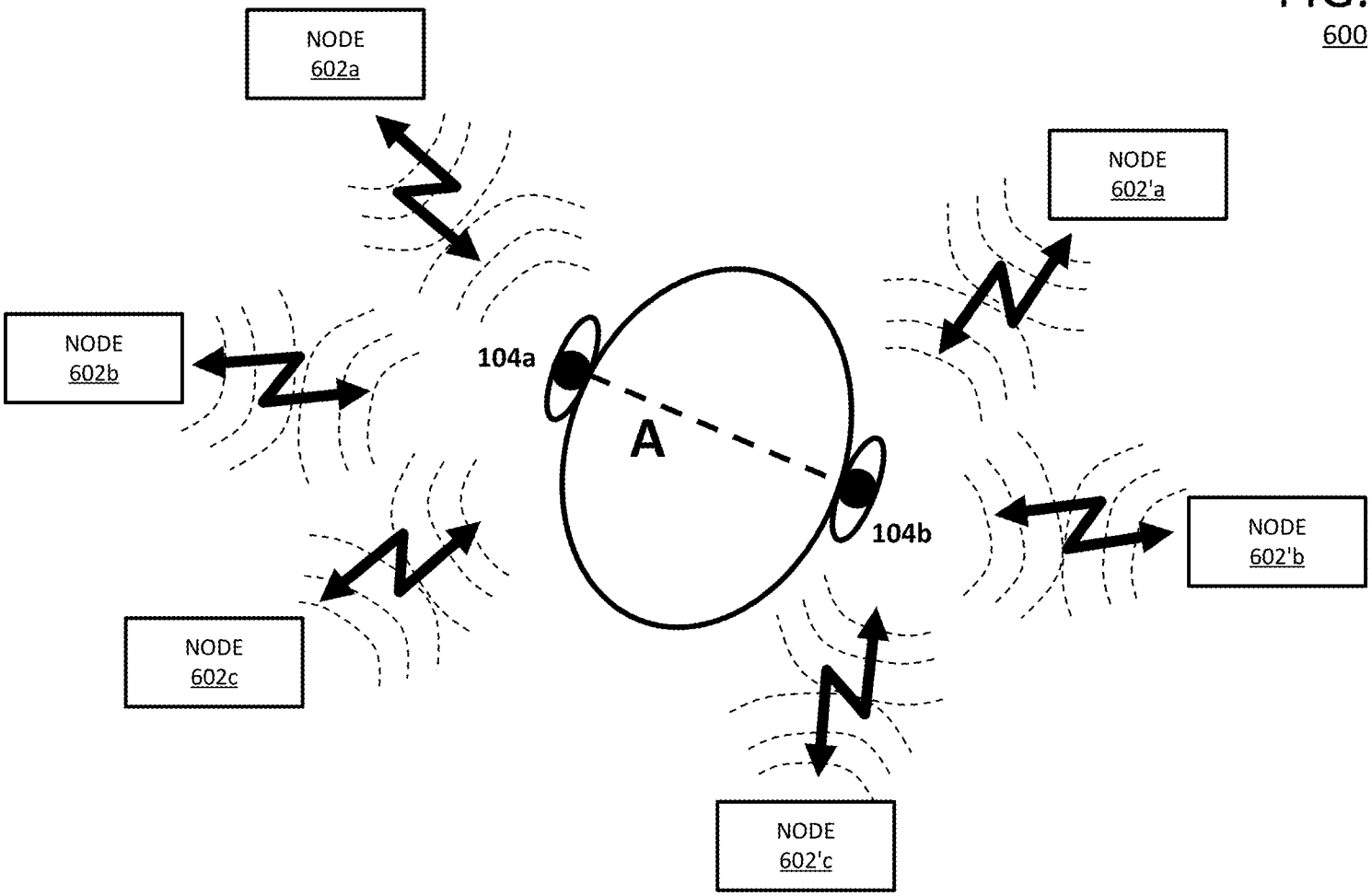
FIG. 6 illustrates a system according to an aspect of the present disclosure.

FIG. 6 provides an exemplary system 600 through which the spatial positions of the left and right ear pieces 104*a*, 104*b* in the environment may be determined, such as in step 502 of the method 500 shown in FIG. 5. The system 600 includes a first plurality of positional nodes 602*a-c* and a second plurality of positional nodes 602'*a-c*, each configured to transmit and receive a wireless ranging signal. The first plurality of nodes 602*a-c* and the second plurality of nodes 602'*a-c* may partially or fully coincide. That is, the node 602*a* and the node 602'*a* may be embodied by the same physical component and likewise with the nodes 602*b*/602'*b* and the nodes 602*c*/602'*c*. The nodes 602*a-c*, 602'*a-c* may each be positioned in the environment at discrete, known positions. The position may be fixed, such as being part of the infrastructure (e.g., the building) of the environment. Yet in some aspects, it is contemplated that the position of the nodes 602*a-c*, 602'*a-c* may be mobile, such as being disposed on the device 110. In the latter case, the position of the nodes 602*a-c*, 602'*a-c* may be ascertained by determining the location of the device 110. In some aspects, the nodes 602*a-c*, 602'*a-c* may be communicatively connected with the server 140.

The spatial positions of the left and right ear pieces 104*a*, 104*b* may be determined using a "time of flight" technique in which the positional transceivers of the left and right ear pieces 104*a*, 104*b* may each transmit a wireless ranging signal. The wireless ranging signal may be received by one or more of the nodes 602*a-c*, 602'*a-c*. In particular, the first plurality of nodes 602*a-c* may receive the wireless ranging signal from the left ear piece 104*a* and the second plurality of nodes 602'*a-c* may receive the wireless ranging signal from the right ear piece 104*b*. Upon receipt of the wireless ranging signal, the nodes 602*a-c*, 602'*a-c* may each transmit back a corresponding wireless ranging signal to the respective positional transceivers of the respective left and right ear pieces 104*a*, 104*b*. The time interval between the initial transmissions of the wireless signals by the left and right ear pieces 104*a, b* and the subsequent receipts of the corresponding return wireless signals from the nodes 602*a-c*, 602'*a-c* may be measured. Based on the known travel speed of the wireless ranging signals, plus any constant time factors caused by transmission and reception processing, the distance between each of the left and right ear pieces 104*a*, 104*b* and each of the respective nodes 602*a-c*, 602'*a-c* may be determined. The distances between each of the left and right ear pieces 104*a*, 104*b* and each of the respective nodes 602*a-c*, 602'*a-c* (the positions of which are known) may be used in geometric triangulation techniques to thus determine the spatial positions of the left and right ear pieces 104*a*, 104*b*.

In some aspects, the nodes 602*a-c*, 602'*a-c* may send an initial ranging wireless signal and the left and right ear pieces 104*a*, 104*b* may each receive the wireless ranging signals and transmit a corresponding wireless ranging signal back to the nodes 602*a-c*, 602'*a-c*. Again, the time intervals between the initial transmission by the nodes 602*a-c*, 602'*a-c* and the subsequent receipt of the corresponding wireless signal from the left and right ear pieces 104*a*, 104*b* may be measured. As above, the time intervals may be used to determine the distance between each of the first plurality of nodes 602*a-c* and the left ear piece 104*a* and the distance between each of the second plurality of nodes 602'*a-c* and the right ear piece 104*b*. Geometric triangulation techniques may be then used to determine the spatial positions of the left and right ear pieces 104*a*, 104*b*. The nodes 602*a-c*, 602'*a-c* may transmit the spatial positions of the left and right ear pieces 104*a*, 104*b* (and/or the time intervals and/or the distances between the left and right ear pieces 104*a, b* and the nodes 602*a-c*, 602'*a-c*) to the ear pieces 104, the device 110, and/or the server 140 so that such information may be analyzed and used to generate information to provide to the user (e.g., head movement instructions).

In an alternative aspect, the positional nodes 602*a-c*, 602'*a-c* may be configured as Wi-Fi access points instead of or in addition to being configured to send and receive wireless ranging signals. In such an aspect, the positional transceivers may exchange Service Set Identifier (SSID) and/or Media Access Control (MAC) data with the nodes 602*a-c*, 602'*a-c*. The Service Set Identifier (SSID) and/or Media Access Control (MAC) data may be used to identify the nodes 602*a-c*, 602'*a-c* and their positions within a space. Further, the Wi-Fi signal strength between the positional transceivers 216*a*, 216*b* and the nodes 602*a-c*, 602'*a-c* may be measured, such as by the ear pieces 104. In a process similar to that described above, the signal strengths may be used to determine the distance between the positional transceivers and the nodes 602*a-c*, 602'*a-c*. The distances may be then used in a triangulation technique to determine the position of each of the ear pieces 104. A similar process using the signal strengths between the positional transceivers and the nodes 602*a-c*, 602'*a-c* also may be employed in an aspect in which the positional nodes 602*a-c*, 602'*a-c* are cellular network transmitters and the measured signal strength is the cellular signal instead of the Wi-Fi signal.

Figure 7:
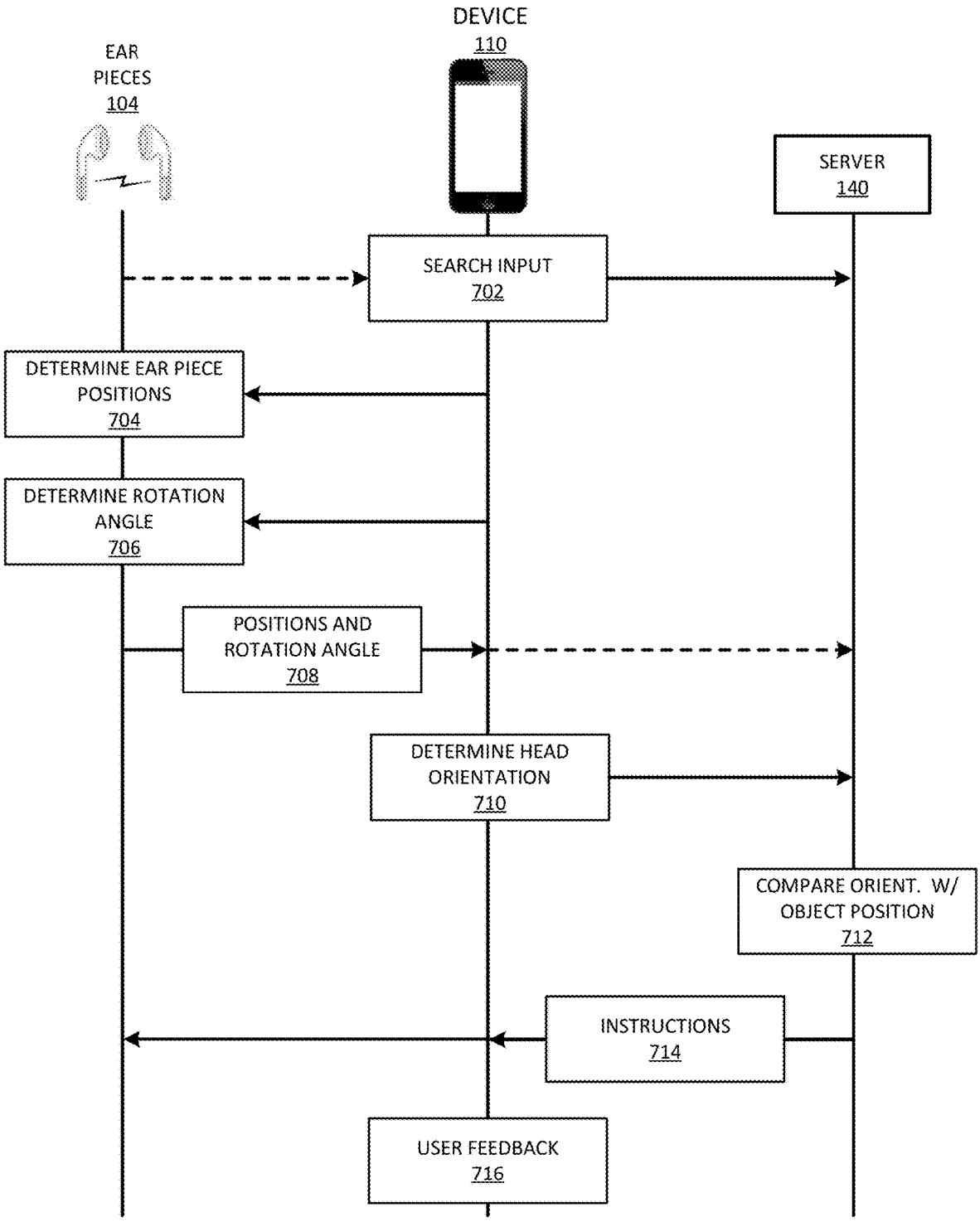
FIG. 7 illustrates a method according to an aspect of the present disclosure.

FIG. 7 illustrates an exemplary method 700 of determining an estimated head orientation and/or position of the user and leveraging that estimated head orientation and/or position to assist the user in locating a specified object. A search input may be provided in which the user specifies an object (e.g., a store product, a museum exhibit, an exit area of a building, an address, etc.) that the user wishes to locate (box 702). Preferably, the specified object is one with associated information in the environmental data repository so that the position of the specified object may be ascertained and used. The search input may be provided by the user via the device 110, as depicted in FIG. 7. In other aspects, the search input may be initially provided by the user via the ear pieces 104. For example, the user may speak the command "please help me locate the tyrannosaurus rex museum exhibit" into the microphone of the ear pieces 104. The search input may be transmitted to the server 140. The transmission of the search input to the server 140 may be performed responsive to the receipt of the search input or may be delayed, such as until or while step 708 is performed.

The method 700 may determine the spatial position ($X_L$, $Y_L$, $Z_L$), ($X_R$, $Y_R$, $Z_R$) of each of the left and right ear pieces (box 704). This may be initiated by the device 110 in response to the device 110 (or the ear pieces, as the case may be) receiving the search input from the user. The spatial position ($X_L$, $Y_L$, $Z_L$), ($X_R$, $Y_R$, $Z_R$) of each of the left and right ear pieces may be determined by exchanging wireless signals with a plurality of nodes, for example, as described above in relation to FIG. 6, or other techniques.

The method 700 may determine the rotation angle δ about the axis A extending between the left and right ear pieces using, for example, the motion sensor (box 706). The determination of the rotation angle δ may be initiated by the device 110 (or the ear pieces, as the case may be).

The spatial positions ($X_L$, $Y_L$, $Z_L$), ($X_R$, $Y_R$, $Z_R$) of each of the left and right ear pieces and the rotation angle δ may be transmitted to the device 110 (box 708). Using the spatial positions ($X_L$, $Y_L$, $Z_L$), ($X_R$, $Y_R$, $Z_R$) of each of the left and right ear pieces 104 and the rotation angle δ, the device 110 may determine the estimated head orientation of the user (box 710). Additionally, the device 110 may determine the spatial position of the user's head (and thus also, approximately, the user). The estimated head orientation may be then transmitted to the server 140 to be used in creating a response to the user's search input. In other aspects, the spatial positions ($X_L$, $Y_L$, $Z_L$), ($X_R$, $Y_R$, $Z_R$) of each of the left and right ear pieces 104 and the rotation angle δ may be instead passed on to the server 140, which thereby may perform the determination of the estimated head orientation. In yet another aspect, the estimated head orientation may be determined by the ear pieces 104. The ear pieces 104 then may transmit the estimated head orientation to the server 140. Alternatively, the ear pieces 104 may transmit the estimated head orientation to the device 110 for the device 110 to further transmit the estimated head orientation to the server 140. In addition to determining the estimated head orientation, the estimated spatial position of the user's head may also be determined using, for example, the spatial positions ($X_L$, $Y_L$, $Z_L$), ($X_R$, $Y_R$, $Z_R$) of each of the left and right ear pieces 104.

The method 700 may compare the estimated head orientation with the position of the object specified in the search input of step 702 to determine whether the object is positioned such that it corresponds with the facing direction of the user's head (box 712). The spatial position of the user's head also may be factored into whether the object is positioned to correspond with the facing of the user's head. For example, information relating to the specified object, including its position, may be accessed from the environmental data repository. In another aspect, the environmental data repository or portions thereof may be downloaded to the device 110 and the device 110 may compare the estimated head orientation and/or position with the position of the object specified in the search input. The device 110 further may determine if the object is positioned to correspond with the facing of the user's head. The environmental data repository may be downloaded to the device 110 as part of step 712 or during any other step of the method 700.

The method 700 may generate instructions based on the comparison of the estimated head orientation and/or position with the position of the specified object and transmit the instructions from the server 140 to the device 110 and/or the ear pieces (box 714). For example, if the comparison indicates that the object does not correspond with the facing direction of the estimated head orientation, the instructions may direct the user to move his or her body and/or adjust the orientation of his or her head. Yet, if the comparison indicates that the object does correspond with the facing direction of the estimated head orientation, the instructions may indicate that the user's head orientation and/or position are correct and that the user should be able to see the object. In either case, further information may be also included in the instructions that may assist the user in locating the object. For example, this further information in the instructions may include an indication of a visual characteristic of the object, such as color, size, or shape.

The method 700 may receive feedback from the user as to whether he or she has located the specified object after receiving the aforementioned instructions (box 716). The feedback may be received from the user by the device 110, as shown in FIG. 7, or by the ear pieces. If the user indicates that he or she has located the object, the method 700 may conclude or may restart at step 702 at which the user may enter a new search input for another object. If the user indicates that he or she has not located the object, step 704 and subsequent steps may be performed again to re-determine the user's (most likely now changed) estimated head orientation and/or spatial position and provide updated instructions to the user. This process may be further repeated until the user indicates that he or she has found the object or otherwise aborts the method 700.

In some aspects, step 704 and subsequent steps may be re-performed without any explicit feedback from the user. That is, the user's estimated head orientation and/or position may be automatically re-determined (either continuously, at set time intervals, or in response to the instructions being received) and new instructions may be provided until the object is positioned to correspond with the facing direction of the user's head.

Figure 8:
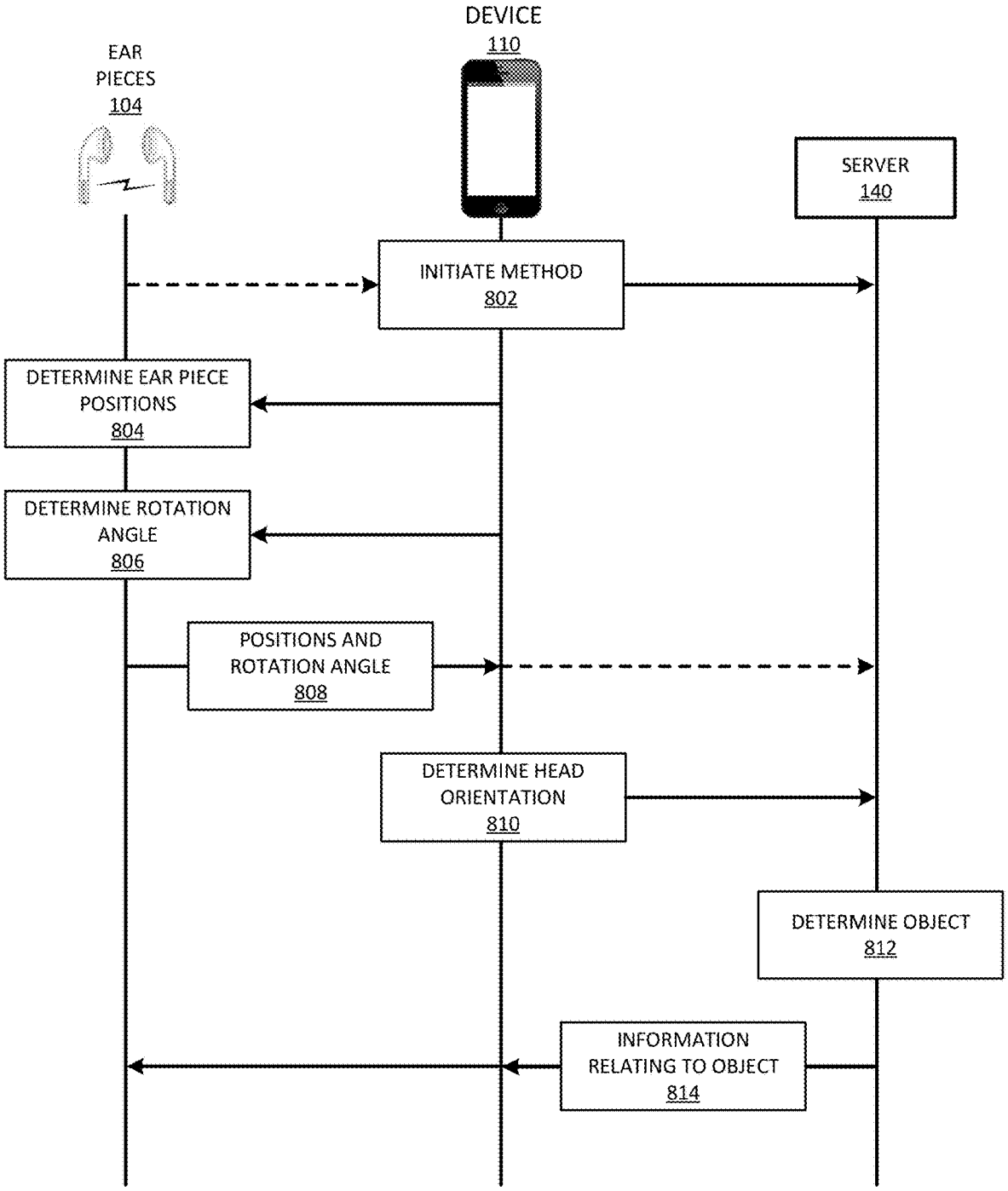
FIG. 8 illustrates a method according to an aspect of the present disclosure.

FIG. 8 illustrates an exemplary method 800 of determining an estimated orientation and/or position of a user's head and using that estimated head orientation and/or position to provide information about an object that corresponds to the facing direction of the user's head. The method 800 may be initiated by the user, such as via the device 110 or the ear pieces (box 802). For example, the user may indicate that he or she wishes to receive information relating to an object at which he or she is looking (i.e., corresponds to the facing direction of the user's head).

The method 800 may determine the spatial positions ($X_L$, $Y_L$, $Z_L$), ($X_R$, $Y_R$, $Z_R$) of each of the left and right ear pieces 104 (box 804). This may be initiated by the device 110 in response to the device 110 (or the ear pieces 104, as the case may be) receiving the indication that he or she wishes to receive information relating to an object within the facing direction of his or her head.

The method 800 may determine the rotation angle δ about the axis A extending between the left and right ear pieces 104 using, for example, the motion sensor 218 (box 806). The determination of the rotation angle δ may be initiated by the device 110 (or the ear pieces, as the case may be).

The spatial positions ($X_L$, $Y_L$, $Z_L$), ($X_R$, $Y_R$, $Z_R$) of each of the left and right ear pieces 104 and the rotation angle δ may be transmitted to the device 110 (box 808). The device 110 may determine the estimated head rotation of the user's head based on the spatial positions ($X_L$, $Y_L$, $Z_L$), ($X_R$, $Y_R$, $Z_R$) of each of the left and right ear pieces 104 and the rotation angle δ (box 810). The estimated head rotation may be then transmitted to the server 140. It is noted that, in other aspects, the spatial positions ($X_L$, $Y_L$, $Z_L$), ($X_R$, $Y_R$, $Z_R$) of each of the left and right ear pieces 104 and the rotation angle δ may instead be transmitted to the server 140, which may determine the estimated head orientation and/or position. In yet another aspect, the estimated head orientation and/or position of the user may be determined by the ear pieces 104. The ear pieces then may transmit the estimated head orientation and/or position to the server 140 or to the device 110 for the device 110 to further transmit the estimated head orientation and/or position to the server 140. In any of the above aspects, the spatial location of the user's head additionally may be determined using the spatial positions ($X_L$, $Y_L$, $Z_L$), ($X_R$, $Y_R$, $Z_R$) of each of the left and right ear pieces 104. The spatial position of the user's head may be a further basis in the various analyses performed with respect to the head orientation.

The method 800 may determine that the position of an object corresponds to the facing direction of the user's head according to the estimated head orientation (box 812). To this end, the area corresponding to the facing direction of the user's head may be cross-referenced with positions of objects from the environmental data repository. One or more objects with a position corresponding to facing direction of the user's head may be thus identified. The determination that the object is positioned to correspond with the facing direction may be performed by the server 140, as depicted in FIG. 8, with reference to the environmental data repository. In another aspect, the determination may be performed by the device 110. To facilitate this determination by the device 110, the environmental data repository or portions thereof may be downloaded to the device 110. The environmental data repository may be downloaded as part of step 812 or during any other step of the method 800.

The method 800 may generate information relating to the object identified in step 812 and may transmit this information to the user, such as via the device 110 or the ear pieces (box 814). The information relating to the object may be in the form of visual text (e.g., for display on the device 110) or auditory speech (e.g., for playback via the ear pieces). The information relating to the object may serve a variety of purposes. As an example, the information relating to a store product may provide the price of the product and a description of the product. As another example, information relating to a museum exhibit may provide an educational description of the exhibit to supplement the user's visual appreciation of the exhibit. In this manner, the method 800 may serve as a sort of tour guide for the user as the user walks through a series of exhibits and receives information on each exhibit in response to the exhibit corresponding to the facing of the user's head. As yet another example, the information relating to a multi-tenant commercial building may include an identification of the various commercial tenants occupying the building and the services offered by each, which may not be readily apparent by merely looking at the building.

Figure 9:
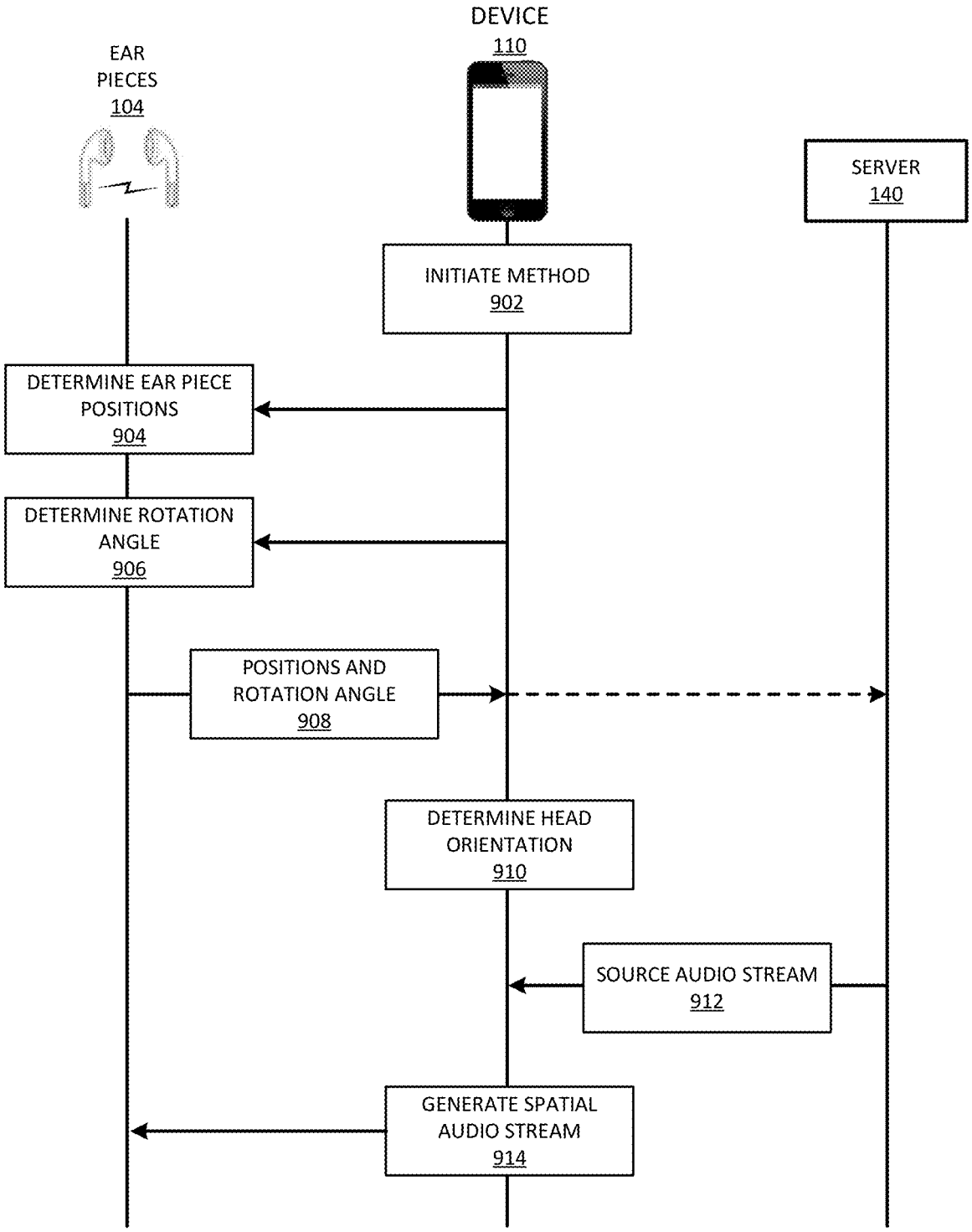
FIG. 9 illustrates a method according to an aspect of the present disclosure.

FIG. 9 illustrates an exemplary method 900 of determining the orientation of a user's head and using that data to generate a spatial audio stream representing audio content that is modified to account for the orientation of the user's head. Additionally, the spatial position of the user's head may be used to generate the spatial audio stream. The spatial audio stream may impart a "spatial" sensation or perception to the user's listening experience as the user varies the orientation and/or position of his or her head. As the user moves or re-orients his or her head, the audio content represented in the spatial audio stream may be likewise altered to give the auditory perception that the user is present and moving within the space of the original source (real or fictitious) of the audio content.

The method 900 may be initiated by the user, such as via the device 110 or the ear pieces 104 (box 902). The initiation of the method 900 may comprise a request from the user to play an audio stream. The user may initiate the method 900 in response to an environment or context in which audio content is available to the user. The available audio content may be provided to the user in conjunction with video or other visual content, such as a movie or program viewed at a movie theater or with an at-home viewing system. As another example, the method 900 may be performed along with a virtual reality system in which audio content is provided in coordination with the computer-generated visual elements of the virtual environment. As yet another example, the audio content may be provided to the user independent of any visual elements. For example, the audio content may comprise music and particularly music derived from original audio content with some spatial aspect, such as a "live" recording of a concert in which the music generally originates from a stage.

The method 900 may determine the spatial positions ($X_L$, $Y_L$, $Z_L$) and ($X_R$, $Y_R$, $Z_R$) for each of the left and right ear pieces 104 (box 904) and the rotation angle δ (FIG. 4) of the user's head about the axis extending between the two ear pieces 104 (box 906) according to the techniques disclosed herein. The method 900 may transmit the spatial positions of the ear pieces 104 and the rotation angle to the device 110 (box 908). The device 110 may thereby determine the estimated orientation of the user's head based on the spatial positions of each of the ear pieces 104 and the rotational angle of the user's head about the axis extending between the two ear pieces 104 (box 910). Further, the spatial position of the user's head may be determined using the spatial positions of the ear pieces 104. The spatial position and orientation of the user's head may be tracked in relation to a fixed point of reference which may correspond with an "audio center" of the audio content. For example, a fixed point of reference may be the center of a movie screen or video display.

In an aspect, the determination of the estimated orientation and position of the user's head may be performed by the server 140 rather than the device 110.

The device 110 may receive a source audio stream (box 912). The source audio stream may be transmitted to the device 110 by the server 140 or other source. Although depicted in FIG. 9 as occurring after step 910, the source audio stream may be transmitted to the device 110 at other times during performance of the method 900. Alternatively, the source audio stream may be already stored on the device 110 and/or the source audio stream may be generated by the device 110. The source audio stream may comprise audio content, such as music, voice content, or sound effects. In one aspect, audio content may be represented in the source audio stream as one or more audio channels. An audio channel may correspond with a spatial aspect of the audio content, such as the relative positions at which the audio content of the various audio channels are intended to be delivered to the user. For example, five of the channels in a 5.1 surround sound format may each correspond to an intended relative position of a loudspeaker, such as a center channel, a front right channel, a front left channel, a back left channel, and a back right channel. In another aspect, the audio content in the source audio stream may comprise a pair of audio channels (e.g., left and right audio channels) each carrying an audio signal designed to provide a "virtual surround sound" effect despite only using the two audio channels.

Having received or accessed the source audio stream, the device 110 may generate a spatial audio stream based on the estimated orientation of the user's head and the source audio stream (box 914). The spatial audio stream may be further based on the spatial position of the user's head. The device 110 may generate a new spatial audio stream based on the source audio stream. Alternatively, generating the spatial audio stream may comprise modifying the source audio stream. The spatial audio stream may carry audio content that is intended to improve the spatial perception of the audio content, such as to give the user a sense of presence at the original source or recording of the audio content (e.g., the actual concert from which a "live" recording is created). The original source of audio content also may be a virtual or fictitious audio source, such as an audio source within a scene in a movie or an environment in a virtual reality application.

The audio content of the spatial audio stream may be generated, at least in part, by setting an audio attribute of the audio content based on the orientation and/or spatial position of the user's head. As an example, in the course of generating the spatial audio stream, the audio content in a number of audio channels may be independently modified to increase or decrease the volume of the audio content in a particular audio channel. As an example, if a user rotates his or head to the left about the vertical axis of the user's body, the volume of the audio content in the right channel may be increased and the volume of the audio content in the left channel may be decreased. Other aspects or attributes of the audio content may be altered besides volume, such as frequency equalization functions, high or low frequency cut-offs, or the relative timing between audio channels. If necessary, the spatial audio stream may be processed to generate left and right audio channels suitable for playback via the respective left and right ear pieces 104. Various "virtual surround sound" techniques may be employed to convert a plurality of audio channels down to just a pair of audio channels while still maintaining the enhanced spatial perspective aspects.

The generating the spatial audio stream may be responsive to a movement of the user's head with respect to orientation and/or spatial positioning. In other aspects, other steps of the method 900 may be performed responsive to the movement of the user's head. For example, the device 110 or other component may not calculate the position and/or orientation of the user's head until some movement of the user's head is detected.

The spatial audio stream may be transmitted to the ear pieces 104 for playback. In one aspect, the ear pieces 104 may receive the source audio stream and generate the spatial audio stream. In another aspect, the server 140 may generate the spatial audio stream and transmit the spatial audio stream to the ear pieces 104, either directly or via the device 110.

In an aspect, the various processes disclosed herein may be supplemented by tracking the position, direction, and/or movement of the user's eyes within their eye cavities, such as by a camera sensor. For example, combining eye tracking with an estimated head orientation and corresponding head facing may allow for more accurate and precise estimate of the direction to which the user is actually looking. Thus, as an example, determined movements, directions, and/or positions of the user's eyes may be used in the method 500 as a further basis for determining the information to provide to the user in step 508. As another example, determined eye movements, directions, and positions may also be used in the method 700 for determining if a sought object is perceptible by the user.

Several aspects of the disclosure are specifically illustrated and/or described herein. However, it will be appreciated that modifications and variations of the disclosure are covered by the above teachings and within the purview of the appended claims without departing from the spirit and intended scope of the disclosure.

I claim:

1. A method comprising:

determining a first spatial position of a first ear piece worn by a user;

determining a second spatial position of a second ear piece worn by the user, wherein the first and second ear pieces are communicatively coupled to each other; and based on the first spatial position of the first ear piece and the second spatial position of the second ear piece, estimating an orientation of the user's head.

2. The method of claim 1, further comprising altering audio output of at least one of the first ear piece and the second ear piece based on the estimated orientation of the user's head.

3. The method of claim 1, further comprising providing contextual information to the user according to a frame of reference defined by the estimated orientation of the user's head.

4. The method of claim 3, further comprising:

receiving an input requesting information to be provided to the user, wherein the providing the contextual information is responsive to the request input.

5. The method of claim 3, further comprising:

based on the first spatial position of the first ear piece and the second spatial position of the second ear piece, estimating a spatial position of the user's head, wherein the providing the contextual information to the user is further based on the spatial position of the user's head.

6. The method of claim 3, wherein the contextual information is provided to the user via the first and second ear pieces.

7. The method of claim 4, wherein the receiving further comprises capturing a parameter of the input via a microphone of the left ear piece or the right ear piece, wherein the contextual information provided to the user is based on the parameter.

8. The method of claim 3, wherein the contextual information is provided to the user via a display of a device communicatively coupled to the left ear piece or the right ear piece.

9. The method of claim 4, wherein the receiving further comprises capturing a parameter of the input via a device communicatively coupled to the first ear piece or the second ear piece, wherein the information provided to the user is based on the parameter.

10. The method of claim 1, wherein the spatial positions of the two ear pieces are estimated by a processor of a device communicatively coupled to the two ear pieces.

11. The method of claim 3, further comprising:

transmitting a search request to a server, wherein the search request includes information derived from the estimated orientation of the user's head; and receiving, from the server, the contextual information provided to the user.

12. The method of claim 1, wherein the spatial positions of the two ear pieces are estimated based on wireless signals received by the respective ear pieces.

13. The method of claim 1, wherein the spatial positions of the ear pieces are estimated based on motion sensor data generated from at least one ear piece.

14. The method of claim 1, wherein the spatial positions of the two ear pieces are estimated by a processor provided in one of the ear pieces.

15. The method of claim 1, further comprising:

determining a first orientation angle representing an orientation of the user's head about an axis extending between the first ear piece and the second ear piece, wherein the estimated orientation of the user's head is determined further based on the first orientation angle.

16. The method of claim 15, wherein:

the first spatial position of the first ear piece comprises a first coordinate set, the second spatial position of the second ear piece comprises a second coordinate set, and the estimating orientation of the user's head further comprises:

determining, based on the first coordinate set and the second coordinate set, a third coordinate set representing a position of the user's head;

determining, based on the first coordinate set and the second coordinate set, a second orientation angle representing a sideways tilt of the user's head; and determining, based on the first coordinate set and the second coordinate set, a third orientation angle representing a swivel of the user's head about an axis of the user's neck, wherein the estimated orientation of the user's head is determined further based on the third coordinate set, the second orientation angle, and the third orientation angle.

17. The method of claim 15, wherein the first orientation angle is determined using a motion sensor disposed in at least one of the first ear piece and the second ear piece.

18. The method of claim 1, wherein the determining the first spatial position of the first ear piece comprises:

transmitting a first set of one or more wireless signals between the first ear piece and a plurality of nodes, each node of the plurality of nodes having a known position;

receiving a second set of one or more return wireless signals, each return wireless signal of the second set corresponding to a wireless signal of the first set;

measuring the time intervals between transmitting each wireless signal of the first set and receiving the corresponding return wireless signal of the second set;

determining, based on the known positions of each node of the plurality of nodes and the measured time intervals, the distances between the first ear piece and each node of the plurality of nodes, wherein the first spatial position of the first ear piece is determined further based on the distances between the first ear piece and each node of the plurality of nodes.

19. The method of claim 1, wherein the estimated orientation of the user's head is determined further based on an orientation of one or more of the user's eyes.

20. The method of claim 3, wherein the contextual information is provided to the user via a computer-generated element displayed in conjunction with a view of the user's environment.

21. The method of claim 20, wherein the user's environment is a virtual environment.

22. A method comprising:

receiving a search input indicative of an object in an environment, the object having a position within the environment;

determining a first spatial position of a first ear piece worn by a user;

determining a second spatial position of a second ear piece worn by the user;

based on the first spatial position of the first ear piece and the second spatial position of the second ear piece, determining an estimated orientation of the user's head;

comparing a facing direction of the estimated orientation of the user's head with the position of the object; and based on the comparison of the facing direction of the estimated orientation of the user's head with the position of the object, generating an instruction to assist the user in locating the object.

23. The method of claim 22, further comprising:

based on the first spatial position of the first ear piece and the second spatial position of the second ear piece, determining a spatial location of user's head, wherein the generating the instruction is based further on the spatial location of the user's head.

24. The method of claim 22, further comprising:

determining that the object corresponds with the facing direction of the estimated orientation of the user's head, wherein the instruction indicates that the object corresponds with the facing direction of the estimated orientation of the user's head.

25. The method of claim 22, wherein the instruction further comprises an indication of a visual characteristic of the object.

26. The method of claim 22, further comprising:

determining that the object does not correspond with the facing direction of the estimated orientation of the user's head, wherein the instruction includes a movement direction for the user.

27. The method of claim 22, further comprising:

receiving feedback from the user indicating that the user has not located the object;

determining a third spatial position of the first ear piece;

determining a fourth spatial position of the second ear piece;

based on the third spatial position of the first ear piece and the fourth spatial position of the second ear piece, determining a second estimated orientation of the user's head;

comparing a facing direction of the second estimated orientation of the user's with the position of the object; and based on the comparison of the facing direction of the second estimated orientation of the user's with the position of the object, generating a second instruction to assist the user in locating the object.

28. A device comprising:

a processor; and memory storing instructions that, when executed by the processor, effectuate operations comprising:

determining a first spatial position of a first ear piece worn by a user;

determining a second spatial position of a second ear piece worn by the user;

based on the first spatial position of the first ear piece and the second spatial position of the second ear piece, determining an estimated orientation of the user's head;

determining that an object is positioned to correspond with a facing direction of the estimated orientation of the user's head; and generating information relating to the object that is to be provided to the user.

29. The device of claim 28, wherein the operations further comprise:

based on the first spatial position of the first ear piece and the second spatial position of the second ear piece, estimating a spatial position of the user's head, wherein the determining that the object is positioned to correspond with the facing direction is further based on the spatial position of the user's head.

30. The device of claim 28, wherein the determining if the object is positioned to correspond with the facing direction of the estimated orientation of the user's head further comprises:

cross-referencing the area corresponding with the facing direction of the estimated orientation of the user's head with the position of each object of a plurality of objects in a repository.

31. The device of claim 28, wherein the operations further comprise:

receiving an indication from the user that the user wishes to receive information relating to the object corresponding with the facing direction of the estimated orientation of the user's head.

32. The device of claim 28, wherein the information relating to the object comprises a price of the object.

33. The device of claim 28, wherein the object comprises an exhibit and the information relating to the object comprises educational information on the exhibit.

34. The device of claim 28, wherein the information relating to the object is in an auditory form.

35. A set of ear pieces to be worn by a user, the set of ear pieces comprising:

a first ear piece comprising a first positional transceiver;

a second ear piece comprising a second positional transceiver; and a processor disposed within at least one of the first ear piece and the second ear piece, the processor configured to effectuate operations comprising:

determining a first spatial position of the first ear piece based on wireless signals received by the first positional transceiver;

determining a second spatial position of the second ear piece based on wireless signals received by the second positional transceiver; and based on the first spatial position of the first ear piece and the second spatial position of the second ear piece, estimating an orientation of the user's head.

36. The set of ear pieces of claim 35, further comprising:

a speaker disposed in at least one of the first ear piece and the second ear piece, wherein the operations further comprise:

providing, via the speaker, information to the user based on the estimated orientation of the user's head.

37. The set of ear pieces of claim 35, wherein the operations further comprise:

based on the first spatial position of the first ear piece and the second spatial position of the second ear piece, estimating a spatial position of the user's head, wherein the providing information to the user is further based on the spatial position of the user's head.

38. The set of ear pieces of claim 36, further comprising:

a microphone disposed in at least one of the first ear piece and the second ear piece, wherein the operations further comprise:

capturing a parameter of a search request via the microphone, wherein the information is based on the parameter.

39. The set of ear pieces of claim 35, further comprising:

a motion sensor disposed in at least one of the first ear piece and the second ear piece, wherein the orientation of the user's head is estimated further based on sensor data captured by the motion sensor.

40. A method comprising:

determining a first spatial position of a first ear piece worn by a user;

determining a second spatial position of a second ear piece worn by the user, wherein the first and second ear pieces are communicatively coupled to each other;

based on the first spatial position of the first ear piece and the second spatial position of the second ear piece, determining an estimated orientation of the user's head; and generating first audio content modified, based on the estimated orientation of the user's head, from second audio content.

41. The method of claim 40, further comprising:

providing the first audio content to the user via the first and second ear pieces.

42. The method of claim 40, wherein the generating the first audio content comprises setting an audio attribute of the first audio content.

43. The method of claim 42, wherein the audio attribute comprises at least one of volume, frequency equalization, high frequency cut-off, low frequency cut-off, and relative timing between channels of the audio content.

44. The method of claim 42, wherein the first audio content comprises a first audio channel and a second audio channel, and wherein the generating the first audio content comprises:

setting an audio attribute of the first audio channel to a first value; and setting an audio attribute of the second audio channel to a second value, different from the first value.

45. The method of claim 40, wherein the determining the estimated orientation of the user's head comprises:

determining an orientation angle about an axis extending between the first ear piece and the second ear piece, wherein the estimated orientation of the user's head is determined based on the orientation angle.

46. The method of claim 40, further comprising:

determining a spatial position of the user's head based on the first spatial position of the first ear piece and the second spatial position of the second ear piece, wherein the generating the first audio content is further based on the spatial position of the user's head.

47. The method of claim 40, further comprising:

converting the first audio content into a left audio channel and a right audio channel, wherein the left audio channel is provided to the user via the first ear piece and the right audio channel is provided to the user via the second ear piece.

48. The method of claim 40, wherein the determining the estimated orientation of the user's head is responsive to a movement of the user's head.

* * * * *